US007744367B1

(12) United States Patent
Kudyba

(10) Patent No.: US 7,744,367 B1
(45) Date of Patent: Jun. 29, 2010

(54) CANDLE-MAINTENANCE TOOL

(76) Inventor: Robert Kudyba, 104 Pearsall Dr., #H-GLA, Mt. Vernon, NY (US) 10552

( * ) Notice: Subject to any disclaimer, the term of this patent is extended or adjusted under 35 U.S.C. 154(b) by 91 days.

(21) Appl. No.: 11/726,529

(22) Filed: Mar. 21, 2007

Related U.S. Application Data

(60) Provisional application No. 60/784,545, filed on Mar. 22, 2006.

(51) Int. Cl.
*F23D 3/28* (2006.01)

(52) U.S. Cl. ..... 431/120; 431/144; 431/292; 431/32; 431/33; 30/113.1; 30/113.2; 30/113.3

(58) Field of Classification Search ..... 7/102, 7/103, 107, 108, 110, 113, 157, 158, 161, 7/165, 167–170; 81/15.2, 15.4, 177.1, 177.4, 81/436, 437, 441, 488, 489, 490; 82/11–13, 82/170; 83/168, 701, 861–864, 866, 867, 83/875, 876, 184; 142/6, 9, 23–42; 144/1.1, 144/3.1, 20, 21, 23, 24.02, 24.16, 48.2, 48.5, 144/49, 92, 104, 218, 219; 264/139, 154, 264/155, 238, 239, 349; 279/2.1, 2.12, 2.19; 401/50; 407/12–18, 30, 33–35, 53, 56, 62–70, 407/100–103; 408/1 BD, 22–26, 54, 72 R; 425/803; 431/33–35, 120, 253, 144, 292, 431/293; 433/165; 30/113.1, 113.2, 113.3, 30/169, 174, 278, 301, 316, 352; *F23D 3/28*
See application file for complete search history.

(56) References Cited

U.S. PATENT DOCUMENTS 265,748 A * 10/1882 Brock ..... 30/279.6
310,003 A * 12/1884 Welshans ..... 7/109
339,123 A * 3/1886 Wood ..... 7/167
414,908 A * 11/1889 Hirschel ..... 7/113
562,416 A * 6/1896 Powers et al. ..... 7/165
843,344 A * 2/1907 Lindeman ..... 30/358
876,663 A * 1/1908 Smith ..... 431/120
994,758 A * 6/1911 Kvindegard ..... 431/34
1,371,948 A * 3/1921 Szutz ..... 30/316
1,448,652 A * 3/1923 Anderson et al. ..... 30/113.1
1,530,822 A * 3/1925 Gibson ..... 30/279.2
1,759,539 A * 5/1930 Carlson ..... 30/279.6

(Continued)

OTHER PUBLICATIONS

Wickman Products—Candle Tool; http://www.wickmanproducts.com/wickman.htm Mar. 21, 2007 (3 pages).

*Primary Examiner*—Steven B McAllister
*Assistant Examiner*—Daniel E Namay
(74) *Attorney, Agent, or Firm*—Mendelsohn, Drucker, & Associates, P.C.

(57) ABSTRACT

A candle-maintenance tool for carving a substantially arcuate path in candle wax of a surface of a candle. The candle-maintenance tool includes a shaft having a candle-contacting surface at one end thereof and a blade coupled to the shaft near the candle-contacting surface. When the candle-contacting surface is pressed into the surface of the candle, at least a portion of the blade contacts the surface of the candle. When the candle-maintenance tool is rotated in place with the candle-contacting surface pressed into the surface of the candle, the blade carves a substantially arcuate path into the surface of the candle.

18 Claims, 3 Drawing Sheets

U.S. PATENT DOCUMENTS 1,906,419 A * 5/1933 Riddell ..... 30/301
2,032,562 A * 3/1936 Burns ..... 30/113.3
2,053,777 A * 9/1936 Pekrol ..... 30/301
2,079,496 A * 5/1937 Domack ..... 30/113.3
2,146,441 A * 2/1939 Powers ..... 431/125
2,360,275 A * 10/1944 Rau ..... 264/160
2,503,064 A * 4/1950 Peterson ..... 30/128
2,557,191 A * 6/1951 King ..... 30/316
2,657,425 A * 11/1953 Keogh ..... 425/113
2,688,157 A * 9/1954 Schroeder ..... 118/426
3,990,451 A * 11/1976 Gibbs ..... 606/174
4,536,156 A * 8/1985 Cattin ..... 433/102
4,596,073 A * 6/1986 Ewald ..... 30/113.1
4,736,657 A * 4/1988 Hicks ..... 81/57.3
5,056,223 A * 10/1991 Buck et al. ..... 30/113.1
5,282,737 A * 2/1994 Ray ..... 431/2
5,989,012 A * 11/1999 Umfleet ..... 431/144
6,519,799 B1 * 2/2003 Bartholomew ..... 7/155
6,688,880 B1 2/2004 Pangle ..... 431/289
6,709,266 B2 * 3/2004 Jensen ..... 431/296
D511,287 S 11/2005 Lake ..... D8/89
7,037,104 B2 5/2006 Azzinaro et al. ..... 431/2
D522,326 S 6/2006 Chance et al. ..... D8/14
7,114,258 B2 * 10/2006 Miller ..... 30/113.2
7,159,320 B2 * 1/2007 Moore ..... 30/113.1
7,647,703 B2 * 1/2010 Demar et al. ..... 30/301
2003/0037440 A1 * 2/2003 Raz ..... 30/113.1
2003/0134243 A1 * 7/2003 Cohen ..... 431/120
2004/0093737 A1 * 5/2004 Mauro ..... 30/113.1
2004/0093738 A1 * 5/2004 Mauro ..... 30/113.1
2007/0101577 A1 * 5/2007 Mauro ..... 30/113.1
2008/0070171 A1 * 3/2008 Dran Gula ..... 431/120
2010/0009305 A1 * 1/2010 Braga et al. ..... 431/120

* cited by examiner

CANDLE-MAINTENANCE TOOL

CROSS-REFERENCE TO RELATED APPLICATIONS

This application claims the benefit of the filing date of co-pending U.S. provisional application No. 60/784,545, filed on Mar. 22, 2006, the teachings of which are incorporated herein by reference.

BACKGROUND OF THE INVENTION

1. Field of the Invention

The present invention relates to candles, and, in particular, to the retrieval of candle wicks that have become embedded in solidified wax.

2. Description of the Related Art

Wax candles have long been used for both aesthetic and functional purposes. A typical wax candle has two components, wax and a wick. The wax serves as a fuel, while the wick, which usually consists of absorbent twine, absorbs liquid wax and moves the liquid wax upward while the candle is burning, to provide a continuous source of fuel.

Wax candles are often used inside glass, metal, ceramic, or other containers, which can make the candle difficult to reach and to light. After a period of burning, candles are often extinguished and then relit.

As shown in FIG. 1, frequent burning and relighting of a typical candle 100 can cause the ignitable end of a wick 101 to become fully immersed in liquid wax in a circular region 102 surrounding wick 101, after the candle is extinguished. Once the wax in region 102 cools, the wick is lost, i.e., fully embedded in solidified wax. Subsequent relighting of the candle requires retrieving or freeing the captive wick from its surrounding wax.

Losing the wick can sometimes be avoided by swirling, tilting, or agitating the candle after extinguishing the wick, to move the melted wax away from the wick, causing the melted wax to adhere to peripheral areas of the candle. Aside from the risk of burns and potential damage from wayward molten wax, this process also requires the foresight, upon extinguishing a candle, to realize that the wick is likely to become lost once the wax in region 102 hardens.

Once the wick is lost, one way to retrieve the wick prior to relighting the candle is to melt the surrounding wax with a match or lighter to expose the wick, which typically involves turning the candle on its side or upside down, so that the flame contacts the wax in region 102. This process can be difficult or impossible, particularly if the candle is located inside a container that hinders access to region 102, or if region 102 is relatively deep within candle 100, due to a resulting inability to apply sufficient force in the necessary directions to carve wax from region 102. The dripping hot wax and exposed flame make this process dangerous, as well. Moreover, heat, smoke, and soot from the burning wax in region 102 can result in discoloration, cracking, burning, and warping of the container or other holder being used.

An alternative heat-based method for wick retrieval permits keeping the candle upright. In this scenario, an open flame or other heat source is placed near region 102 to soften the wax, while a knife or other tool is used to dig out the wax surrounding the wick. While this reduces the chance of injury from dripping hot wax, the open flame or other heat source still presents a risk of burns. Also disadvantageously, after the wick has been retrieved in this manner, an unattractive and irregular area within region 102 typically results.

To reduce the problems associated with wick retrieval, certain specialized wick-retrieval tools have been developed.

One such wick-retrieval tool, as shown in FIG. 2, is a wax-cutting tool 200 having a handle 201, a shank 202, and a scoop-shaped end 203. The scoop-shaped end 203, which resembles a miniature melon baller, has sharp edges that can cut through unheated solid wax, eliminating the risks of using an adjacent heat source to melt the wax in region 102. To use tool 200, the user holds handle 201 and manually pushes or pulls scoop-shaped end 203 downward, in a generally circular path around wick 101 within region 102, so as to eventually carve a generally circular recess around wick 101. However, the sharp edges of scoop-shaped end 203 pose a risk of cutting both nearby fingers and the wick itself, if the user is not sufficiently careful. Also, just as with heat-based wick retrieval methods, an unattractive and irregular area within region 102 can easily result, depending on the manual dexterity of the user. Moreover, when the scooping process is finished, a pile of wax shavings remains in and near region 102, which requires removal prior to relighting, in addition to wax shavings ending up in the general vicinity of the candle as well. Another disadvantage of tool 200 is that, if region 102 is relatively deep within candle 100, or if candle 100 is located inside a container that hinders access to region 102, then tool 200 becomes difficult or impossible to use due to a resulting inability to apply sufficient force in the necessary directions to carve wax from region 102.

Other wick-retrieval tools are illustrated in U.S. Design Pat. Nos. D511,287 to Lake and D522,326 to Chance et al., both of which show handheld tools that appear to have ends adapted for digging in wax and grasping a candle wick. Each of these tools still appears to require that a heat source be placed near region 102 to soften the wax, while the tool is used to dig out the wax surrounding the wick and to grasp the wick.

Another wick-retrieval tool, which is disclosed in U.S. Pat. No. 7,037,104 to Azzinaro et al., is a large pistol-shaped tool resembling a hot-glue gun or soldering iron. The tool has an elongate hollow heated tube, which is heated by a heating source to a temperature sufficient to substantially soften or liquefy candle wax. A working end of the heated elongate hollow tube is inserted into the candle wax around the embedded ignitable end of a wick. The candle and the tool are then inverted, and the wax around the wick flows through the interior of the heated elongate hollow tube and out a draining end of the heated elongate hollow tube, thereby exposing the embedded wick. This tool uses house current and has a power cord that must be plugged into a nearby outlet to power the heating element, thereby limiting the tool's range of use. The user must also wait at least several minutes after plugging in the tool before the elongate hollow tube is sufficiently hot to melt candle wax, and the tool must be kept away from people, pets, and nearby objects during preheating to avoid burns. Additionally, because the user must invert the candle and the tool while using the tool, injury caused by dripping hot wax and the hot heating tube is possible. Moreover, this tool is relatively expensive to produce and is not practical for the average consumer.

SUMMARY OF THE INVENTION

Problems in the prior art are addressed in accordance with the principles of the present invention by providing a wick-retrieval tool that is safe and easy to use, requires minimal manual dexterity, requires no heat source, is easy to clean, and incorporates other candle-maintenance functionality in a single device.

In one embodiment, the present invention provides a candle-maintenance tool for carving a substantially arcuate path in candle wax of a surface of a candle. The candle-maintenance tool includes a shaft having a candle-contacting surface at one end thereof and a blade coupled to the shaft near the candle-contacting surface. When the candle-contacting surface is pressed into the surface of the candle, at least a portion of the blade contacts the surface of the candle. When the candle-maintenance tool is rotated in place with the candle-contacting surface pressed into the surface of the candle, the blade carves a substantially arcuate path into the surface of the candle.

In another embodiment, the present invention provides a candle-maintenance tool including a shaft having a substantially annular surface at one end thereof and a handle disposed at the other end thereof, and a blade coupled to the shaft near the substantially annular surface and disposed within the shaft.

In a further embodiment, the present invention provides a method for carving a substantially arcuate path in candle wax of a surface of a candle using a candle-maintenance tool. The candle-maintenance tool includes a shaft having a candle-contacting surface at one end thereof and a blade coupled to the shaft near the candle-contacting surface. The method includes pressing the candle-contacting surface into the surface of the candle, such that at least a portion of the blade contacts the surface of the candle. The method further includes rotating the candle-maintenance tool in place with the candle-contacting surface pressed into the surface of the candle, such that the blade carves a substantially arcuate path into the surface of the candle.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
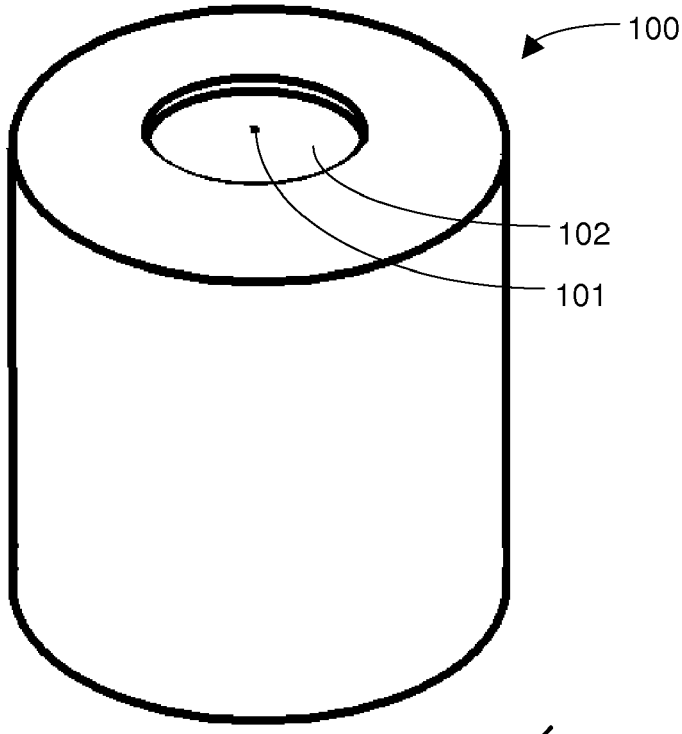
FIG. 1 (Prior Art)
FIG. 1 is a perspective view of a wax candle having a wick that is fully embedded in solidified wax.
Figure 2:
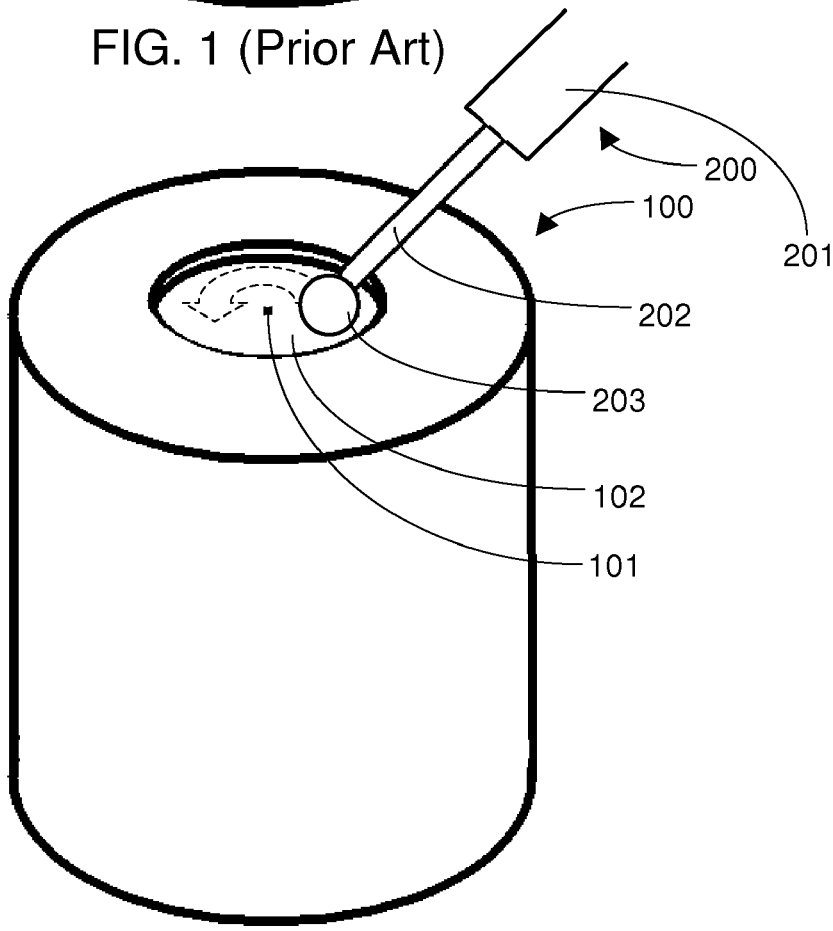
FIG. 2 (Prior Art)
FIG. 2 is a perspective view of a prior-art scoop-type wax-cutting tool being used to carve a recess around the embedded wick.
Figure 3:
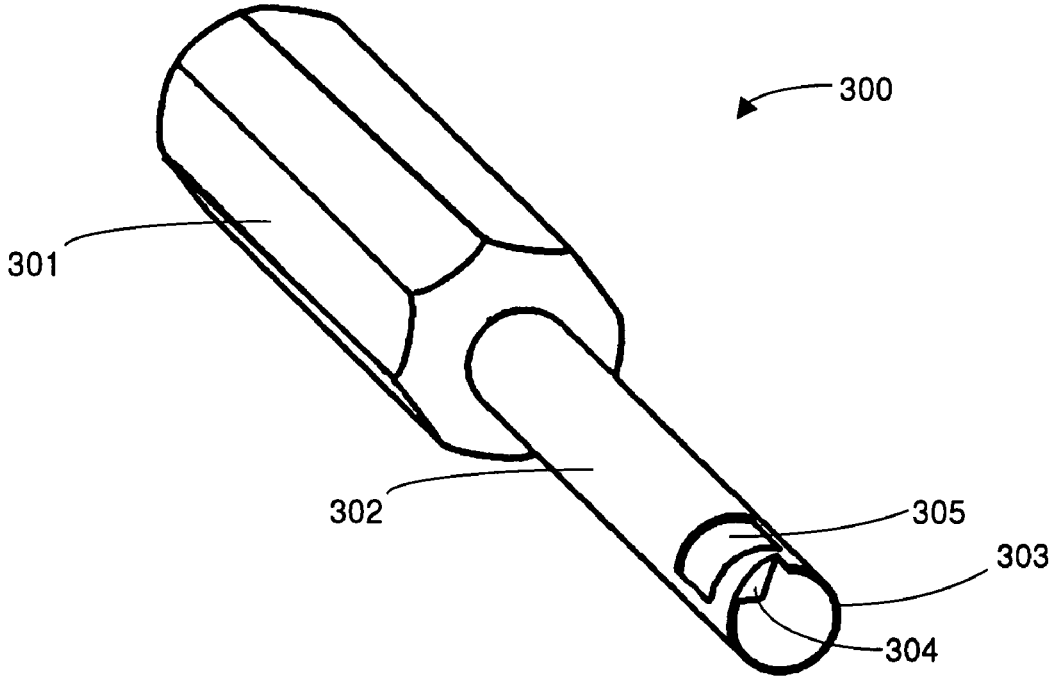
FIG. 3 is a perspective view of a candle-maintenance tool consistent with a first embodiment of the present invention.
Figure 4:
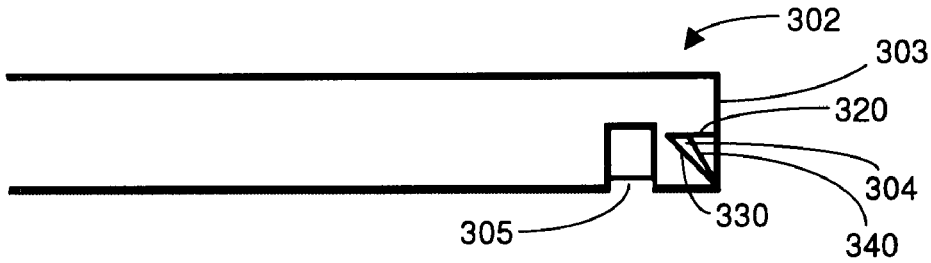
FIG. 4 is a side perspective view of the shank of the candle-maintenance tool of FIG. 3.
Figure 5:
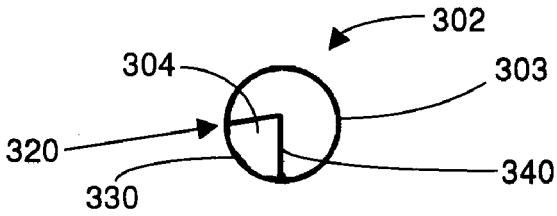
FIG. 5 is an end perspective view of the shank of the candle-maintenance tool of FIG. 3.

FIGS. 3, 4, and 5 illustrate a candle-maintenance tool 300 consistent with a first exemplary embodiment of the present invention, which can be used to expose the ignitable end of a candle wick embedded in the solidified wax of a candle. As shown, candle-maintenance tool 300 comprises a handle 301 at one end of a tubular shank 302. While handle 301 is depicted as having a generally octagonal cross-section, handle 301 may have practically any shape and size and may be made of wood, plastic, rubber, or other material suitable for hand-gripping. Shank 302 can have practically any length and diameter. At the opposite end of shank 302 from handle 301 is a cutting end 303 that has a sharpened, discontinuous annular cutting surface, a portion of which is bent to project inward, thereby forming a generally triangular blade portion 304.

As best seen in FIGS. 4 and 5, during manufacture, blade portion 304 can be constructed from tubular shank 302 having a pre-sharpened circular cutting end 303, by cutting shank 302 along line 320 and bending blade portion 304 inward, along the fold of line 330. Since cutting end 303 is pre-sharpened prior to bending blade portion 304 inward, the leading edge 340 of blade portion 304 is sharp, as well. Cutting end 303 and leading edge 340 are sufficiently sharp to cut through solid wax. The angle at which blade portion 304 is folded inward along line 330 is selected to permit cutting the wax in region 102 surrounding wick 101 when tool 300 is in use, as will be described in further detail below, without cutting wick 101 itself.

As best seen in FIGS. 3 and 4, a generally rectangular exit hole 305 is formed in shank 302 near blade portion 304 of cutting end 303.

Figures 6, 7:
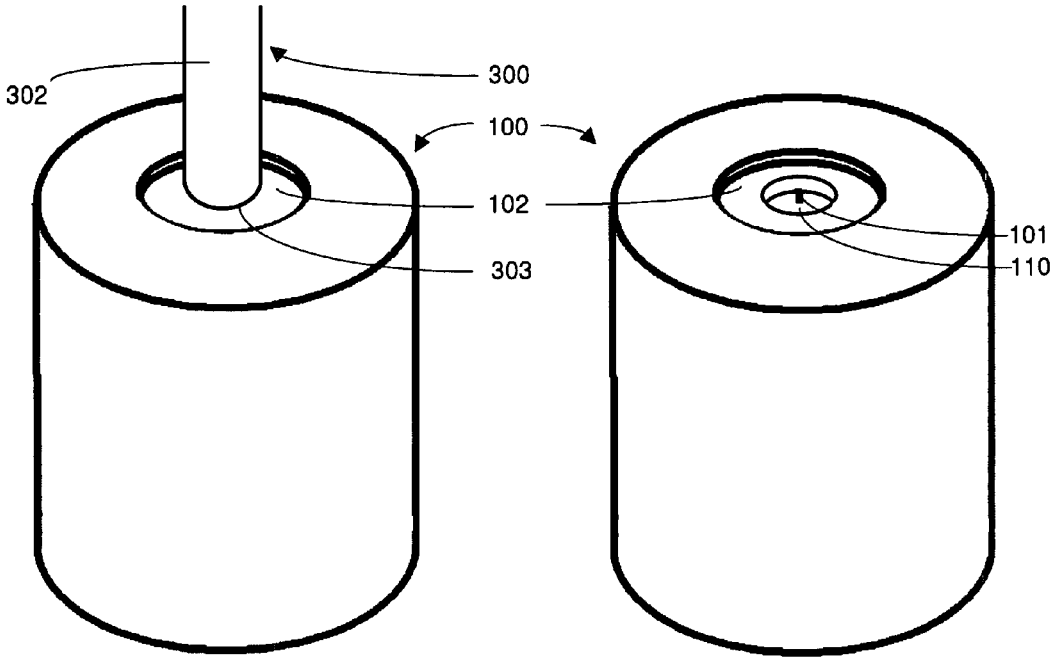
FIG. 6 is a perspective view of the shank of the candle-maintenance tool of FIG. 3 being used to carve a recess around the embedded wick.
FIG. 7 is a perspective view of the recess carved around the previously-embedded wick by the candle-maintenance tool of FIG. 3.

With reference to FIGS. 6 and 7, the use of candle-maintenance tool 300 in a wick-retrieval operation will now be described. The user holds tool 300 by its handle 301 and places cutting end 303 on top of candle 100, as shown in FIG. 6, centering cutting end 303 around wick 101. Since the solidified wax in region 102 will nearly always be substantially circular, the outer edges of region 102 can be used to ensure visually that cutting end 303 and the central axis of tool 300 are substantially coaxial with wick 101 and region 102.

Once the user is satisfied with the centering of tool 300 around wick 101, the user presses down firmly on handle 301 in the direction of candle 100 and rotates tool 300 in place, in a clockwise direction. The clockwise rotation of tool 300 drives leading edge 340 of blade portion 304 in a clockwise path of travel around wick 101, while cutting a substantially arcuate path into the wax of region 102. After several rotations of tool 300, a wick-freeing recess 110 is created around wick 101, as shown in FIG. 7. The user continues rotating tool 300 and pressing down on handle 301 until wick-freeing recess 110 reaches a desired depth, such that a suitable length of wick is exposed. During this process, wax shavings are pushed upward into shank 302 towards handle 301. These wax shavings exit shank 302 via exit hole 305.

Prior to carving out wick-freeing recess 110, the user can take additional steps to verify that tool 300 is properly centered around wick 101. First, the user gently presses down on handle 301, in the direction of candle 100, while gently rotating tool 300, so that cutting end 303 forms only a shallow circular recess (not shown) in region 102. The user can then lift tool 300 away from candle 100 and verify visually that the shallow circular recess is coaxial with wick 101 before proceeding with the wick-retrieval operation. In the event that the shallow circular recess is not properly centered, the user can adjust the location of cutting end 303 relative to wick 101 and, once again, gently press down on the handle and rotate tool 300, to create a new shallow circular recess. The user can verify visually the location of the new shallow circular recess and adjust the location of cutting end 303 as may be necessary, and so forth, until the user is satisfied that cutting end 303 is coaxial with wick 101, before proceeding to carve a deeper recess in region 102.

Figure 8:
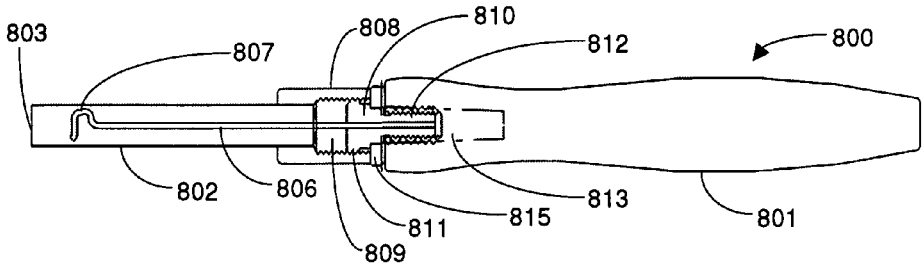
FIG. 8 is a side sectional view of a candle-maintenance tool consistent with a second embodiment of the present invention.
Figure 9:
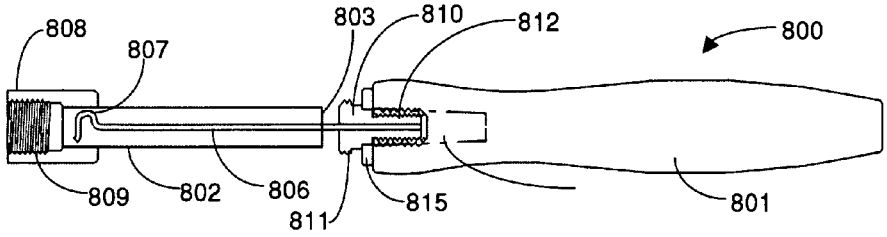
FIG. 9 is a side sectional view of the candle-maintenance tool of FIG. 7, with the shank being cleaned out using the snuffer hook.

FIGS. 8 and 9 illustrate a candle-maintenance tool 800 consistent with a second exemplary embodiment of the present invention. Some similarities exist between tool 800 and tool 300 of FIGS. 3-5. As with tool 300, tool 800 has a handle 801 and a tubular shank 802. The portions of tool 800 that are used for exposing the ignitable end of a candle wick embedded in the solidified wax of a candle are substantially the same as those of tool 300, including generally triangular blade portion 304. Therefore, although FIGS. 8 and 9 show cutting end 803, which is substantially the same as cutting end 303, the inwardly-bent, generally triangular blade portion of cutting end 803 is omitted from FIGS. 8 and 9 and the following accompanying description.

Tool 800 has a number of differences relative to tool 300, which will now be described.

A first difference from tool 300 of FIGS. 3-5 is that handle 801 of tool 800 has a different shape from handle 301 (of FIGS. 3-5). In particular, handle 801 is a modified cylinder having varying diameters along its length. Handle 801 is generally dome-shaped at its free end to receive a user's palm and is slightly flared toward its other end to provide support to the ends of the user's fingers. In this manner, torque is applied largely by way of the user's palm, which is maintained in contact with handle 801 by way of pressure applied from the user's arm and frictional resistance at the user's skin. The user's fingers, although transmitting some force, occupy more of a stabilizing role, which reduces fatigue, since less power is required to drive tool 800 during the process of freeing a wick.

A second difference from tool 300 of FIGS. 3-5 is that tool 800 includes an integral snuffer hook 807 disposed inside tubular shank 802, which is sized so that snuffer hook 807 fits and freely reciprocates within shank 802. Snuffer hook 807 is formed at one end of snuffer wire 806, the other end of which is affixed to and disposed coaxially inside a snuffer connector 810. Handle 801 has a threaded recess 813 formed therein and, at the opening of threaded recess 813, has an annular metal shoulder plate 815 with an aperture of substantially the same diameter as the opening of threaded recess 813. Shoulder plate 815 and threaded recess 813 are adapted to receive a threaded first end 812 of snuffer connector 810, which passes through the aperture in shoulder plate 815 while being screwed into threaded recess 813 and stops at shoulder plate 815 once fully screwed into place.

A third difference from tool 300 of FIGS. 3-5 is that, unlike tubular shank 302, which is fixedly attached to handle 301, tubular shank 802 of tool 800 is threadably detachable from handle 801. A shank connector 808 is disposed at the end of shank 802 opposite cutting end 803. Shank connector 808 has a threaded aperture 809 formed therein, which is adapted to receive a threaded second end 811 of snuffer connector 810.

During use of tool 800 to expose the ignitable end of a candle wick embedded in the solidified wax of a candle, shank 802 remains attached to handle 801 by this threaded interface between shank connector 808 and snuffer connector 810.

During use of tool 800 as a snuffer, shank 802 is detached from handle 801 by unscrewing shank connector 808 from snuffer connector 810 and removing and placing shank 802 aside, exposing snuffer hook 807. Snuffer hook 807 allows the user to dip a lit wick into surrounding molten wax in region 102 to extinguish the flame and then lift the wick back up to prevent the wick from becoming buried in the wax. After being lifted back up, the wick stands upright in preparation for the next lighting.

A fourth difference from tool 300 of FIGS. 3-5 is that tool 800 has no exit hole comparable to exit hole 305 of tool 300, and therefore, wax shavings remain inside shank 802 of tool 800 after use. This is advantageous, because it reduces or eliminates wax shavings being left on and in the vicinity of the candle after tool 800 is used. In a subsequent step, these shavings can be cleaned out using the integral snuffer hook 807. As shown in FIG. 9, by removing and inverting shank 802 and inserting snuffer hook 807 into cutting end 803 of shank 802, snuffer hook 807 serves as a poking or scraping device to assist in pushing or pulling out wax that has collected inside shank 802.

Tool 800 is desirably about 10 to 12 inches in length, to provide access to deep candles. Metal components of tool 800, and, in particular, snuffer wire 806, snuffer hook 807 and shank 802, are desirably rust-proof and strong enough to resist being broken during use.

In alternative embodiments, other variations are possible. For example, in certain embodiments, the tool could include ruler markings (e.g., from 1 to 20 mm), which could serve as a depth guide for the cutting process.

A butane-filled lighter with refill capability could be provided on a non-cutting end of the tool.

A device for inserting a wick extender, as disclosed, e.g., in U.S. Pat. No. 6,688,880 to Pangle, could also be included as part of the tool.

The handle could be telescoping or could have an extender for hard-to-reach or longer candles.

Instead of being manually driven by rotating the handle, the tool could alternatively be motor-driven or ratchet-driven.

A heating source could be provided, e.g., within the handle, to heat the cutting end of the tool and soften the wax being cut.

The cutting end and/or blade portion could include one or more serrated, beveled, or double edges. In certain embodiments, the cutting end of the tool could be made blunt enough so as not to cause any cutting from simple rubbing of the tool on the user's finger, but sharp enough to penetrate solid wax. Alternatively, the cutting end could be blunt, while only the inwardly-bent blade portion is sharp, to protect a user's fingers. Accordingly, the terms "surface" and "candle-contacting surface" are used herein to refer generally to a cutting end (e.g., element 303 of FIGS. 3-5 or element 803 of FIGS. 8-9), regardless of whether the cutting end is sharp or blunt.

In alternative embodiments, the blade portion can be constructed in ways other than bending a portion of the cutting end of the shank inward, and the blade portion can have shapes and dimensions other than those specifically shown and described herein. For example, additional material, such as a separate blade component, could be added to the shank by welding or otherwise joining such material to the shank. The term "blade," as used herein, should be interpreted broadly to mean a blade portion (e.g., blade portion 304 of FIGS. 3-5), the leading edge of a blade portion, or any other cutting tool or surface in a device consistent with various embodiments of the present invention, used to create a substantially arcuate or cylindrical path around a wick.

While, in the description above, tool 300 of FIGS. 3-5 is rotated in a clockwise direction while in use, it should be understood that a tool consistent with certain embodiments of the present invention could alternatively be rotated in a counter-clockwise direction, depending on the orientation of the blade portion.

In other embodiments, the candle-contacting surface could be a continuous annular surface, rather than a discontinuous annular surface, such that a surface in the shape of a complete circle could be provided at the cutting end in conjunction with an inwardly-projecting blade portion. Thus, the term "substantially annular" should be understood to include embodiments having a continuous annular candle-contacting surface, as well as embodiments having a discontinuous annular candle-contacting surface.

It should be recognized that the entire leading edge of the inwardly-bent blade portion does not need to cut into the wax for a tool consistent with certain embodiments of the present invention to function properly. The angle at which the blade portion is folded inward is selected to permit cutting the wax in the region surrounding the wick without cutting the wick itself and may result in only certain portions of the leading edge of the blade portion contacting or cutting the wax. Also, instead of a single inwardly-bent blade portion (or similar blade feature), a plurality of inwardly-bent blade portions (e.g., two opposing blade portions) could alternatively be provided to accelerate the cutting process. In a multiple-blade embodiment, the leading edges of the blades could alternatively be arranged in opposing directions, such that the tool could be twisted back and forth while in use, alternating between a clockwise rotation and a counter-clockwise rotation, rather than being rotated in a single direction.

The term "snuffer tool" should be understood to include both a snuffer wire (e.g., element 806 of FIGS. 8 and 9) and a snuffer hook (e.g., element 807 of FIGS. 8 and 9) formed from the snuffer wire, and can also include other types of snuffers.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A candle-maintenance tool for carving a substantially arcuate path in candle wax of a surface of a candle, the candle-maintenance tool comprising:

a shaft having a candle-contacting surface at one end thereof and a rotational axis;

an elongated handle disposed at an end of the shaft opposite the candle-contacting surface;

a blade formed from a substantially triangular portion of the candle-contacting surface of the shaft bent inwardly, wherein a line along which the blade is bent is at an oblique angle relative to the rotational axis of the shaft, the blade having a cutting surface that faces the candle-contacting surface of the shaft, with at least a portion of the cutting surface disposed to face the rotational axis of the shaft; and a substantially rectangular aperture formed in the shaft between the inwardly-bent portion of the candle-contacting surface of the shaft and the elongated handle, the aperture located near the blade and away from the handle, wherein:

when the candle-contacting surface is pressed into the surface of the candle, at least a portion of the blade is adapted to contact the surface of the candle; and when the candle-maintenance tool is rotated in place with the candle-contacting surface pressed into the surface of the candle, the blade is adapted to carve a substantially arcuate path into the surface of the candle.

2. The invention of claim 1, further comprising a snuffer tool connected to the handle.

3. The invention of claim 2, wherein the shaft is detachable from the handle to expose the snuffer tool.

4. The invention of claim 3, wherein the snuffer tool is adapted to reciprocate freely within the shaft to clean the inside of the shaft, when the shaft is detached from the handle.

5. The invention of claim 2, wherein the snuffer tool is detachably connected to the handle.

6. The invention of claim 1, wherein the candle-contacting surface is substantially annular.

7. The invention of claim 1, wherein the candle-contacting surface comprises at least one sharpened portion.

8. The invention of claim 1, wherein at least a portion of the shaft comprises a circumferentially-continuous tube.

9. A candle-maintenance tool comprising:

a shaft having a substantially annular surface at one end thereof, a handle disposed at the other end thereof, and a rotational axis, the shaft having at least one generally tubular portion;

wherein the handle is an elongated handle disposed at an end of the shaft opposite the candle-contacting surface;

a blade formed from a substantially triangular portion of the substantially annular surface of the shaft bent inwardly along a line which is at an oblique angle relative to the rotational axis of the shaft and disposed within a generally tubular portion of the shaft, the blade having a cutting surface that faces away from the handle; and a substantially rectangular aperture formed in the shaft between the inwardly-bent portion of the candle-contacting surface of the shaft and the elongated handle, the aperture located near the blade and away from the handle.

10. The invention of claim 9, further comprising a snuffer tool and connected to the handle.

11. The invention of claim 10, wherein the shaft is detachable from the handle to expose the snuffer tool.

12. The invention of claim 11, wherein the snuffer tool is adapted to clean the inside of the shaft when the shaft is detached from the handle.

13. The invention of claim 10, wherein the snuffer tool is detachably connected to the handle.

14. The invention of claim 9, wherein the candle-contacting surface is a discontinuous annular surface.

15. The invention of claim 9, wherein the candle-contacting surface comprises at least one sharpened portion.

16. The invention of claim 9, wherein the at least one generally tubular portion of the shaft is circumferentially continuous.

17. A method for carving a substantially arcuate path in candle wax of a top surface of a candle using a candle-maintenance tool, the top surface defined as the surface of the candle in which an end of a wick intended for lighting is disposed, the method comprising:

providing a candle-maintenance tool comprising:

a shaft having a candle-contacting surface at one end thereof and a longitudinal rotational axis; and a blade coupled to the shaft near the candle-contacting surface;

pressing the candle-contacting surface into the top surface of the candle such that (i) the candle contacting surface surrounds the wick, (ii) the rotational axis of the shaft is substantially aligned with the wick of the candle and (ii) at least a portion of the blade contacts the top surface of the candle; and rotating the candle-maintenance tool in place about the rotational axis of the shaft, with the candle-contacting surface pressed into the top surface of the candle, such that the blade carves a substantially arcuate path around the wick into the top surface of the candle, and such that the blade does not cut the wick.

18. A candle-maintenance tool comprising:

a shaft having a substantially annular surface at one end thereof, a handle disposed at the other end thereof, and a rotational axis, the shaft having at least one generally tubular portion;

a blade formed from a portion of the substantially annular surface of the shaft bent inwardly at an oblique angle relative to the rotational axis of the shaft and disposed within a generally tubular portion of the shaft, the blade having a cutting surface that faces away from the handle; and a snuffer tool, wherein at least a portion of the snuffer tool is disposed within the shaft and/or handle.

* * * * *